US009528751B2

(12) United States Patent
Sexton et al.

(10) Patent No.: US 9,528,751 B2
(45) Date of Patent: Dec. 27, 2016

(54) STORAGE ASSEMBLIES

(71) Applicant: Electrolux Home Products, Inc., Charlotte, NC (US)

(72) Inventors: Terry Lynn Sexton, Anderson, SC (US); Jason Lee Purucker, Anderson, SC (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 1 day.

(21) Appl. No.: 14/558,106

(22) Filed: Dec. 2, 2014

(65) Prior Publication Data

US 2016/0153702 A1 Jun. 2, 2016

(51) Int. Cl.
*F25D 23/12* (2006.01)
*F25D 11/00* (2006.01)
*F25D 23/06* (2006.01)

(52) U.S. Cl.
CPC ..... *F25D 23/12* (2013.01); *F25D 11/00* (2013.01); *F25D 23/067* (2013.01)

(58) Field of Classification Search
CPC ..... B65D 25/22; F25D 23/12; F25D 11/00; F25D 23/067
USPC ..... 220/482, 480, 481, 476; 248/318, 322, 248/339, 215, 213.2, 311.2
See application file for complete search history.

(56) References Cited

U.S. PATENT DOCUMENTS 1,474,660 A * 11/1923 White ..... E04G 11/46 248/215
2,284,905 A * 6/1942 Jackson ..... F25D 7/00 312/31
2,579,895 A * 12/1951 Anderssen ..... A45C 11/20 211/106
2,652,171 A * 9/1953 Johnson ..... E05B 65/006 220/327
3,477,679 A * 11/1969 Lovitz ..... A47B 96/061 119/252
4,739,582 A * 4/1988 Cullinane ..... A47G 7/044 47/41.12
4,759,193 A * 7/1988 Dehring ..... F25D 11/02 62/258
6,302,365 B1 * 10/2001 Catanzarite ..... A47G 25/0614 248/215
6,364,260 B1 * 4/2002 Lorincz ..... A47B 96/06 211/113
6,854,610 B2 * 2/2005 Adams ..... A47G 25/0614 211/118
7,044,424 B2 * 5/2006 Robertson ..... A47F 3/0439 206/561
8,360,381 B2 * 1/2013 Lee ..... A47G 7/044 211/106.01
8,517,483 B2 * 8/2013 Eubanks ..... F25D 17/042 312/404

(Continued)

*Primary Examiner* — Fenn Mathew
*Assistant Examiner* — Robert Stodola
(74) *Attorney, Agent, or Firm* — Pearne & Gordon LLP

(57) ABSTRACT

A structure includes an upstanding wall that has a first surface that is located at the exterior of the upstanding wall and a second surface that is located at the interior of the upstanding wall. A free edge of the upstanding wall joins the first surface and the second surface of the upstanding wall. A storage assembly is supported at the free edge of the upstanding wall. The storage assembly includes at least one of a first storage unit that is located at the exterior surface of the upstanding wall and a second storage unit that is located at the interior surface of the upstanding wall.

5 Claims, 2 Drawing Sheets

(56) References Cited

U.S. PATENT DOCUMENTS

2003/0204903 A1* 11/2003 Moster ..... A47K 3/004
4/559

* cited by examiner

FIG. 1
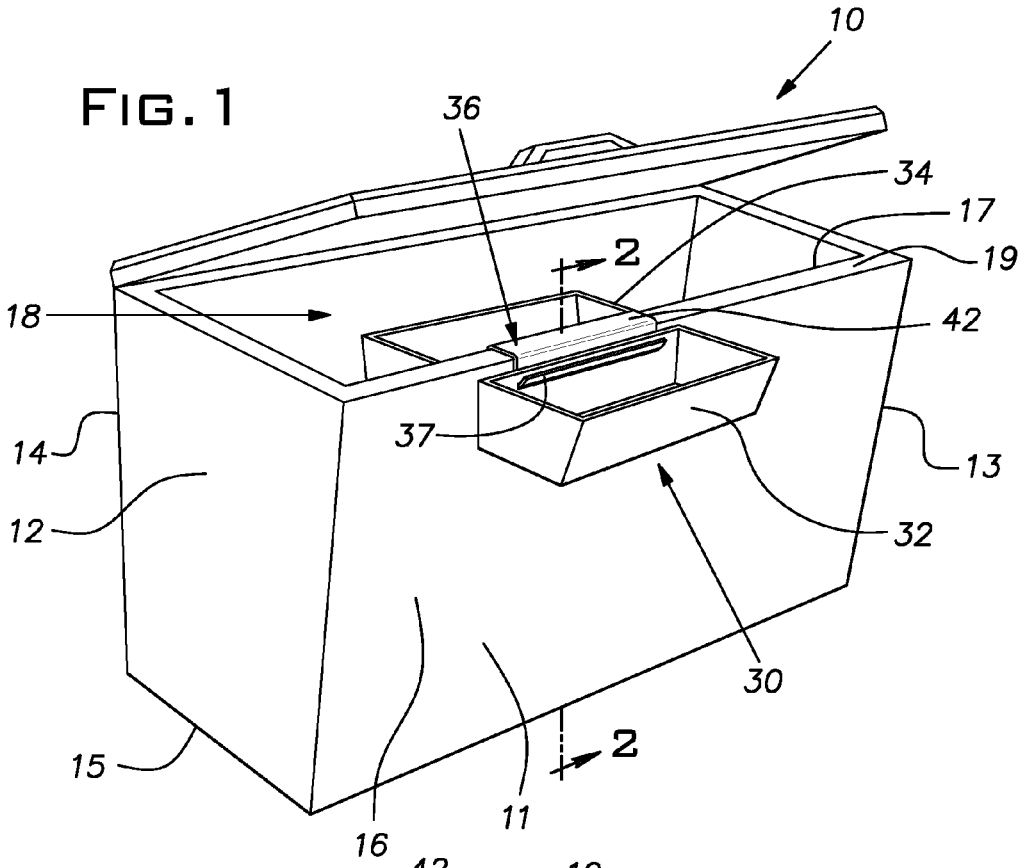
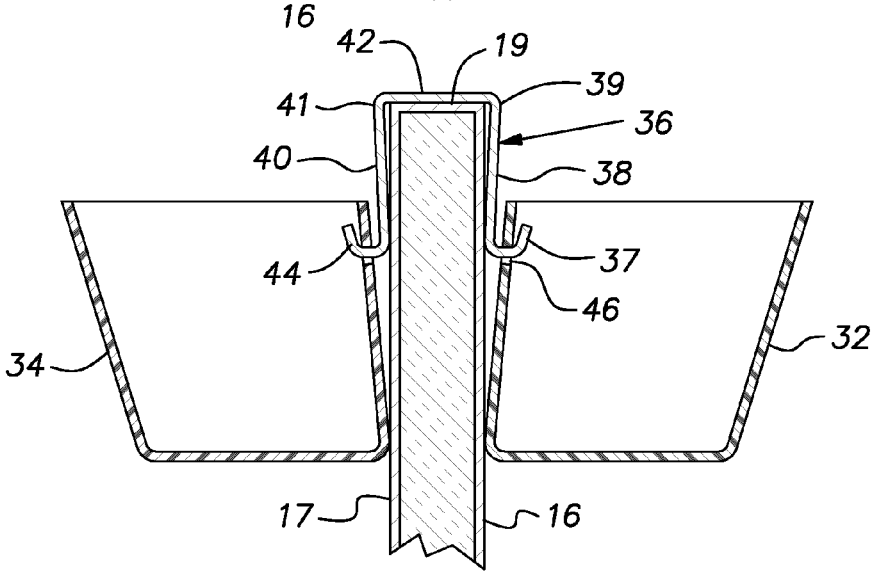
FIG. 2

STORAGE ASSEMBLIES

FIELD OF THE INVENTION

The present invention relates, in general, to storage assemblies and, in particular, to storage assemblies for refrigeration appliances.

BACKGROUND OF THE INVENTION

Storage assemblies of many types are known in the art. In many instances, the storage assemblies are designed to uniquely address a particular need or a particular requirement. For example, a need has been identified for a storage assembly that can serve as an adjunct to the typical storage arrangements that are provided with freezer appliances while adhering to standards promulgated by the Association of Home Appliance Manufacturers. Such a storage assembly is provided in accordance with one aspect of the present invention. Additional aspects of the present invention concern storage assemblies that can be applied in other contexts.

BRIEF SUMMARY OF THE INVENTION

The following presents a simplified summary of the invention in order to provide a basic understanding of some aspects of the invention. The summary does not comprise an extensive overview of the invention nor is the summary intended to either identify key or critical elements of the invention or delineate the scope of the invention. The sole purpose of the summary is to present some concepts of the invention in a simplified form as a prelude to the more detailed description that is presented later herein.

According to one aspect of the present invention, a refrigeration appliance can include an upstanding wall that has a first surface that is located at the exterior of the refrigeration appliance, a second surface that is located at the interior of the refrigeration appliance and a free edge that is joined to the first surface and the second surface of the upstanding wall. The free edge is arranged and is configured to engage a closure member of the refrigeration appliance. A storage assembly can be supported at the free edge of the upstanding wall of the refrigeration appliance. The storage assembly can include at least one of a first storage unit that is located at the exterior surface of the upstanding wall and a second storage unit that is located at the interior surface of the upstanding wall.

According to another aspect, with the refrigeration appliance described in the previous paragraph, the storage assembly can include a hanger that is freely supported at the free edge of the upstanding wall of the refrigeration appliance and the at least one of the first storage unit and the second storage unit can be releasably secured to the hanger.

According to a further aspect, the hanger can include a hanger first leg that is located at the first surface of the upstanding wall and a hanger second leg that is located at the second surface of the upstanding wall. A hanger connecting leg can connect a hanger first leg first end with a hanger second leg first end and rest on the free edge of the upstanding wall. A first storage unit can be releasably secured to the hanger first leg and a second storage unit can be releasably secured to the hanger second leg.

According to yet another aspect, the hanger first leg can include a first leg hooked portion that is located at a hanger first leg second end and the first storage unit can be releasably secured to the first leg hooked portion of the hanger first leg. Also, the hanger second leg can include a second leg hooked portion that is located at a hanger second leg second end and the second storage unit can be releasably secured to the second leg hooked portion of the hanger second leg.

According to yet a further aspect, the first storage unit can include an opening through which the first leg hooked portion of the hanger first leg extends to releasably secure the first storage unit to the first leg hooked portion of the hanger first leg. Also, the second storage unit can include an opening through which the second leg hooked portion of the hanger second leg extends to releasably secure the second storage unit to the second leg hooked portion of the hanger second leg.

According to yet an additional aspect, each of the first storage unit and the second storage unit can comprise a container, and the refrigeration appliance can comprise a freezer.

According to still another aspect a storage assembly can include a hanger that includes a hanger first leg that has a hanger first leg first end and a hanger second leg that has a hanger second leg first end. A hanger connecting leg can connect the hanger first leg first end with the hanger second leg first end and each of the hanger first leg and the hanger second leg can extend in the same direction from the hanger connecting leg and form a space therebetween. Thereby, the hanger can be configured to be supported at the hanger connecting leg between the hanger first leg and the hanger second leg. A first storage unit can be releasably supported at the hanger first leg, and a second storage unit can be releasably supported at the hanger second leg.

According to still a further aspect, the hanger first leg can include a hanger first leg second end that is arranged opposite the hanger first leg first end. The hanger first leg second end can include a first leg hooked portion and the first storage unit can be releasably secured to the first leg hooked portion of the hanger first leg. The hanger second leg can include a hanger second leg second end that is arranged opposite the hanger second leg first end. The hanger second leg second end can include a second leg hooked portion, and the second storage unit can be releasably secured to the second leg hooked portion of the hanger second leg.

According to still an additional aspect, the first storage unit can include an opening through which the first leg hooked portion of the hanger first leg extends to releasably secure the first storage unit to the first leg hooked portion of the hanger first leg. Also, the second storage unit can include an opening through which the second leg hooked portion of the hanger second leg extends to releasably secure the second storage unit to the second leg hooked portion of the hanger second leg.

According to one more aspect, each of the first storage unit and the second storage unit can comprise a container.

The following description and accompanying drawings set forth in detail certain illustrative aspects of the invention. These aspects are indicative, however, of but a few of the various ways in which the principles of the invention may be employed, and the present invention is intended to include all aspects of the invention and their equivalents. Other objects, advantages and novel features of the invention will become apparent from the following detailed description of the invention when considered in conjunction with the accompanying drawings.

BRIEF DESCRIPTION OF THE DRAWINGS

The foregoing and other features and advantages of the present invention will become apparent to those skilled in the art to which the present invention relates upon reading the following description with reference to the accompanying drawings, in which:

FIG. 1 is a perspective view of an embodiment of the invention;

FIG. 2 is a partial cross-sectional view taken along lines 2-2 of FIG. 1;

DESCRIPTION OF EXAMPLE EMBODIMENTS

Figure 3:
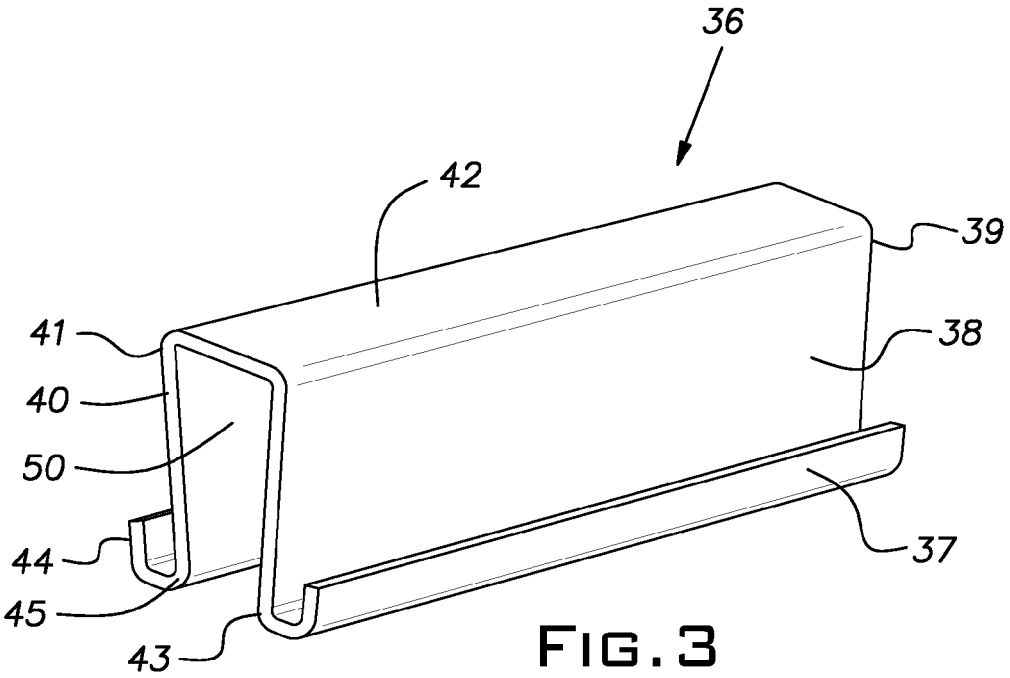
FIG. 3 is a perspective view of a first component of an example of a storage assembly that is in accordance with an aspect of the invention.

The present invention will now be described with reference to the drawings, wherein like reference numerals are used to refer to like elements throughout. It is to be appreciated that the various drawings are not necessarily drawn to scale from one figure to another or within a given figure. The sizes of the components are somewhat arbitrarily drawn in order to facilitate an understanding of the drawings. In the following description, numerous specific details are set forth in order to provide a thorough understanding of the present invention, but it can be possible in certain instances to practice the present invention without those specific details.

Referring first to FIG. 1, there is illustrated a particular embodiment of a refrigeration appliance, indicated generally at 10, that includes an example of a storage assembly, indicated generally at 30, that can serve as a storage adjunct for the refrigeration appliance 10. In the embodiment of FIG. 1, the refrigeration appliance 10 is shown by way of example to comprise a freezer which includes an upstanding wall 11 that in the embodiment of FIG. 1 comprises the front wall of the freezer. The refrigeration appliance 10 also includes a first side wall 12, a second side wall 13 and a rear wall 14, all of which comprise upstanding walls, and a bottom wall 15. The upstanding wall 11, in the form of the front wall of the refrigeration appliance 10, includes a first surface 16 that is located at the exterior of the refrigeration appliance, and a second surface 17 that is located at the interior, indicated generally at 18, of the refrigeration appliance 10. Similarly, each of the other upstanding walls of the refrigeration appliance, i.e., the first side wall 12, the second side wall 13 and the rear wall 14, include an exterior surface and an interior surface.

The upstanding wall 11 also includes a free edge 19 that extends along the entire length of the top of the upstanding wall 11. Similarly, as can be seen in FIG. 1, each of the first side wall 12, the second side wall 13 and the rear wall 14 also includes a respective free edge that extends along the entire length of the top of the wall. The free edge 19 of the upstanding wall 11 is joined to the first surface 16 of the upstanding wall and the second surface 17 of the upstanding wall 11.

The refrigeration appliance additionally includes a closure member 20, which in the embodiment of the figures comprises a lid, that can be hinged at the rear wall 14. The closure member 20 serves to close off the interior 18 of the refrigeration appliance 10 to the exterior of the refrigeration appliance. Thus, the free edge 19 of the upstanding wall 11 is configured to engage the closure member 20, as are each of the free edges of the first side wall 12, the second side wall 13 and the rear wall 14.

As can be seen in FIGS. 1 and 2, the storage assembly 30 is supported at the free edge 19 of the upstanding wall 11 of the refrigeration appliance 10. The storage assembly 30 includes at least one of a first storage unit 32 that is located at the exterior surface 16 of the upstanding wall 11 and a second storage unit 34 that is located at the interior surface of the upstanding wall 11. In the embodiment illustrated in FIGS. 1 and 2, both the first storage unit 32 and the second storage unit 34 are shown as being present at the refrigeration appliance 10.

In the example storage assembly 30 shown in FIGS. 1 and 2, the storage assembly includes a hanger, indicated generally at 36, that is freely supported at the free edge 19 of the upstanding wall 11 of the refrigeration appliance 10. The hanger is freely supported in the sense that it is not affixed at the upstanding wall 11, including at the free edge 19 of the upstanding wall 11. However, the hanger can be affixed at the upstanding wall 11, including at the free edge 19, by fasteners or adhesives, for example, as will be familiar to those having ordinary skill in the art. At least one of the first storage unit 32 and the second storage unit 34 is releasably secured to the hanger 36. As shown in the example illustrated in FIGS. 1 and 2, both the first storage unit 32 and the second storage unit 34 are releasably secured to the hanger 36.

Referring to FIGS. 2 and 3, the example hanger 36 is shown to include a hanger first leg 38 that is located at the first surface 16 of the upstanding wall 11 and a hanger second leg 40 that is located at the second surface 17 of the upstanding wall 11. A hanger connecting leg 42 connects a hanger first leg first end 39 of the hanger first leg 38 with a hanger second leg first end 41 of the hanger second leg 40. The hanger connecting leg 42 rests on the free edge 19 of the upstanding wall 11. More specifically, the hanger first leg 38 and the hanger second leg 40 each extend in the same direction from the hanger connecting leg 42 and form a space 50 therebetween, whereby the hanger 36 is configured to be supported at the hanger connecting leg 42 between the hanger first leg 38 and the hanger second leg 40.

The first storage unit 32 is releasably secured to the hanger first leg 38 and the second storage unit 34 is releasably secured to the hanger second leg 40. More particularly, as best seen in FIGS. 2 and 3, the hanger first leg 38 includes a first leg hooked portion 37 that is located at a hanger first leg second end 43 of the hanger first leg 38 arranged opposite the hanger first leg first end 39, and the first storage unit 32 is releasably secured to the first leg hooked portion 37 of the hanger first leg 38. Also, the hanger second leg 40 includes a second leg hooked portion 44 that is located at a hanger second leg second end 45 of the hanger second leg 40 arranged opposite the hanger second leg first end 41, and the second storage unit 34 is releasably secured to the second leg hooked portion 44 of the hanger second leg 40.

The one or two storage units that can be included with the storage assembly 30 can comprise any kind of a unit that can hold an item or article of any kind. In the embodiment of the storage assembly illustrated in the drawings, the first storage unit 32 and the second storage unit 34 comprise open-top solid-wall containers that can be made of plastic or metal for example. However, the storage units can comprise wire baskets or merely shelves for example.

Figure 4:
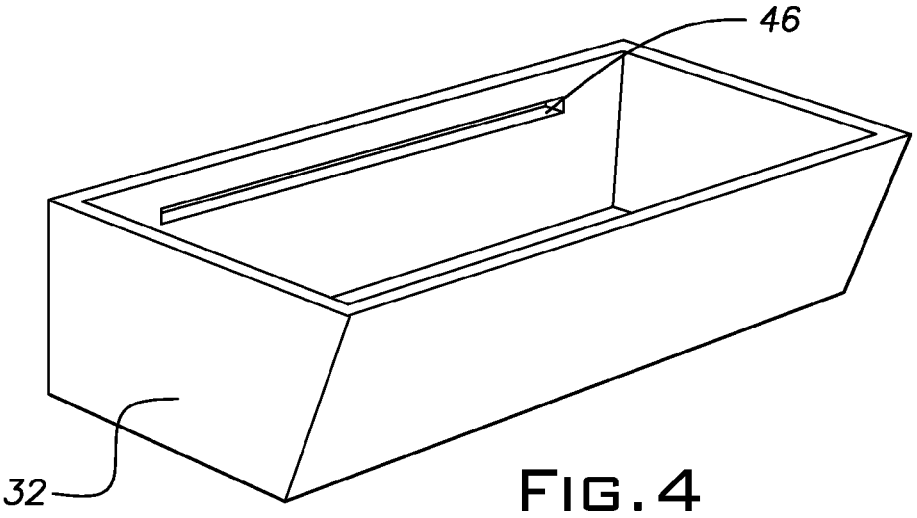
FIG. 4 is a perspective view of a second component of an example of a storage assembly that is in accordance with an aspect of the invention.

In the instance of the example embodiment illustrated in the drawings, the first storage unit 32, as best seen in FIGS. 2 and 4, includes an opening 46 through which the first leg hooked portion 37 of the hanger first leg 38 extends to releasably secure the first storage unit 32 to the first leg hooked portion 37 of the hanger first leg 38. In that example embodiment, the opening 46 comprises an elongated slot through which the first leg hooked portion 37 of the hanger first leg 38, which is complementarily elongated, extends. The second storage unit 34 includes an opening like the opening 46 of the first storage unit 32 through which the second leg hooked portion 44 of the hanger second leg 40 extends to releasably secure the second storage unit 34 to the second leg hooked portion 44 of the hanger second leg 40.

Although the storage assembly 30 has been described as being supported at the free edge 19 of the upstanding wall 11 comprising the front wall of the refrigeration appliance 10, the storage assembly can be supported at a respective free edge of any of the first side wall 12, the second side wall 13 and the rear wall 14, all of which comprise upstanding walls. In any of these circumstances, the closure member 20, typically, will include a seal around its perimeter that engages the free edges of the various walls when the closure member is closed. It will be understood by those skilled in the art that the seal can be fashioned so as to accommodate the structure of the hanger 36 at the free edge on which it rests. In this regard, the hanger connecting leg 42 of the hanger 36 can be recessed into the free edge 19 so that the upper surface of the connecting leg 42 is flush with the surface of the free edge 19.

The invention has been described above using specific examples; however, it will be understood by those having ordinary skill in the art that various alternatives may be used and equivalents may be substituted for elements or steps described herein without deviating from the scope of the invention. For example, although the invention has been particularly described with reference to a refrigeration appliance comprising a freezer, the invention also can comprise other types of refrigeration appliances such as insulated chests including insulated chests that can variously contain ice for cooling or the interior of which can be cooled by other means for preserving articles maintained at the interiors of the insulated chests. Indeed, the storage assembly of the invention can be employed with a variety of structures other than refrigeration appliances that include an upstanding wall at which the storage assembly can be supported. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A freezer including:

an upstanding wall having a first surface located at an exterior of the freezer, a second surface located at an interior of the freezer and a free edge that is joined to the first surface and the second surface of the upstanding wall and is configured to engage a closure member of the freezer; and a storage assembly supported at the free edge of the upstanding wall of the freezer, the storage assembly including:

a hanger freely supported at the free edge of the upstanding wall of the freezer, the hanger including a hanger first leg located at the first surface of the upstanding wall, a hanger second leg located at the second surface of the upstanding wall, and a hanger connecting leg connecting a hanger first leg first end with a hanger second leg first end and resting on the free edge of the upstanding wall;

a first storage unit configured to hold an item located at the exterior surface of the upstanding wall; and a second storage unit configured to hold an item located at the interior surface of the upstanding wall;

wherein, the first storage unit is releasably secured to the hanger first leg and the second storage unit is releasably secured to the hanger second leg.

2. The freezer of claim 1 wherein: the hanger first leg includes a first leg hooked portion located at a hanger first leg second end and the first storage unit is directly releasably secured to the first leg hooked portion of the hanger first leg; and the hanger second leg includes a second leg hooked portion located at a hanger second leg second end and the second storage unit is directly releasably secured to the second leg hooked portion of the hanger second leg.

3. The freezer of claim 2 wherein:

the first storage unit includes an opening through which the first leg hooked portion of the hanger first leg extends to releasably secure the first storage unit to the first leg hooked portion of the hanger first leg; and the second storage unit includes an opening through which the second leg hooked portion of the hanger second leg extends to releasably secure the second storage unit to the second leg hooked portion of the hanger second leg.

4. The freezer of claim 3 wherein:

a width of the first leg hooked portion is coextensive with a width of the hanger first leg first end and a width of a portion of the hanger first leg that joins the hanger first leg first end and the hanger first leg second end; and a width of the second leg hooked portion is coextensive with a width of the hanger second leg first end and a width of a portion of the hanger second leg that joins the hanger second leg first end and the hanger second leg second end.

5. The freezer of claim 4 wherein a width of the first storage unit opening is coextensive with the width of the portion of the hanger first leg that joins the hanger first leg first end and the hanger first leg second end and a width of the second storage unit opening is coextensive with the width of the portion of the hanger second leg that joins the hanger second leg first end and the hanger second leg second end.

* * * * *